US011591190B2

(12) United States Patent
Sirén et al.

(10) Patent No.: US 11,591,190 B2
(45) Date of Patent: Feb. 28, 2023

(54) HYDRAULIC CRANE

(71) Applicant: Cargotec Patenter AB, Ljungby (SE)

(72) Inventors: Sten Sirén, Pargas (FI); Per Gustafsson, Hudiksvall (SE); Lars Rydahl, Hudiksvall (SE)

(73) Assignee: Hiab AB, Kista (SE)

( * ) Notice: Subject to any disclaimer, the term of this patent is extended or adjusted under 35 U.S.C. 154(b) by 1164 days.

(21) Appl. No.: 16/095,832

(22) PCT Filed: Apr. 20, 2017

(86) PCT No.: PCT/EP2017/059323
§ 371 (c)(1),
(2) Date: Oct. 23, 2018

(87) PCT Pub. No.: WO2017/186549
PCT Pub. Date: Nov. 2, 2017

(65) Prior Publication Data

US 2021/0229965 A1 Jul. 29, 2021

(30) Foreign Application Priority Data

Apr. 25, 2016 (EP) ..... 16166896

(51) Int. Cl.
*B66C 23/90* (2006.01)
*B66C 13/20* (2006.01)
(Continued)

(52) U.S. Cl.
CPC ..... *B66C 23/905* (2013.01); *B66C 13/20* (2013.01); *B66C 13/44* (2013.01); *B66C 13/46* (2013.01);
(Continued)

(58) Field of Classification Search
CPC ..... B66C 23/54; B66C 23/705; B66C 23/905; B66C 13/20; B66C 13/46; B66C 13/44; B66C 2700/0392
See application file for complete search history.

(56) References Cited

U.S. PATENT DOCUMENTS 3,367,514 A * 2/1968 Georg ..... B66C 13/18 414/541
3,854,593 A * 12/1974 Gross ..... F15B 13/02 340/685
(Continued)

FOREIGN PATENT DOCUMENTS

DE 3145719 A1 6/1982
EP 2298689 A2 3/2011
(Continued)

*Primary Examiner* — Michael R Mansen
*Assistant Examiner* — Juan J Campos, Jr.
(74) *Attorney, Agent, or Firm* — Dilworth & Barrese, LLP

(57) ABSTRACT

A hydraulic crane comprising: —a rotatable column (7); —a crane boom system (10) comprising two or more liftable and lowerable crane booms (11, 13); and —an electronic control device (25), which is configured to prevent an execution of crane boom movements that would make the lifting moment of the crane exceed the maximum allowed lifting moment of the crane, and to continuously establish position information as to the prevailing position of the load suspension point (P) of the crane boom system. When the lifting moment of the crane has reached a limit value at a given level below the maximum allowed lifting moment, the electronic control device is configured to prevent the execution of any combination of crane boom movements that would increase the horizontal distance between the load suspension point and said vertical axis of rotation and at the same time allow the
(Continued)

execution of any combination of crane boom movements that keeps said horizontal distance unchanged or reduces said horizontal distance.

11 Claims, 3 Drawing Sheets

(51) Int. Cl.

| | |
|---|---|
| ***B66C 13/44*** | (2006.01) |
| ***B66C 13/46*** | (2006.01) |
| ***B66C 23/68*** | (2006.01) |
| ***B66C 23/70*** | (2006.01) |
| ***B66C 23/00*** | (2006.01) |
| *B66C 23/42* | (2006.01) |
| *B66C 23/78* | (2006.01) |

(52) U.S. Cl.
CPC ..... *B66C 23/54* (2013.01); *B66C 23/705* (2013.01); *B66C 23/42* (2013.01); *B66C 23/78* (2013.01); *B66C 2700/0371* (2013.01); *B66C 2700/0378* (2013.01); *B66C 2700/0392* (2013.01)

(56) References Cited

U.S. PATENT DOCUMENTS

| | | | | |
|---|---|---|---|---|
| 3,963,127 | A * | 6/1976 | Eriksson | B66C 23/90 212/230 |
| 4,411,368 | A * | 10/1983 | Manjot | B66C 23/905 212/278 |
| 5,877,693 | A | 3/1999 | Eyler | |
| 2002/0005112 | A1* | 1/2002 | Badia Ba | B66C 23/705 91/168 |
| 2013/0092648 | A1* | 4/2013 | Haberl | B66C 23/54 212/276 |

FOREIGN PATENT DOCUMENTS

| | | | |
|---|---|---|---|
| GB | 2078197 | A | 1/1982 |
| WO | 2008/143584 | A1 | 11/2008 |

* cited by examiner

HYDRAULIC CRANE

FIELD OF THE INVENTION AND PRIOR ART

The present invention relates to a hydraulic crane.

In order to avoid overloading of a hydraulic crane, it is known to establish a maximum allowed value for the lifting moment of the crane, which takes into account the strength and stability of the crane. This maximum allowed value for the lifting moment of the crane is in the following denominated "lifting moment maximum value". The lifting moment maximum value may be a fixed value or a variable value established in dependence on the swing-out angle of the inner boom of the crane and possibly further variables defining the prevailing position of the crane boom system of the crane. The lifting moment maximum value is normally converted into a corresponding value for the maximum allowed working pressure for the lifting cylinder of the crane, and by limiting this working pressure it is secured that the lifting moment of the crane will not exceed the maximum allowed lifting moment. An overload protection system of a hydraulic crane is normally configured to stop presently executed crane boom movements when the lifting moment of the crane has reached the lifting moment maximum value, wherein the overload protection system is configured to only allow such a stop to be directly followed by an execution of a crane boom movement which is expected to reduce the lifting radius of the crane. This is normally achieved in that certain directions of movement of individual crane booms are blocked by preventing individual hydraulic cylinders from moving in specific directions. An overload protection system of this kind is for instance previously known from GB 2 078 197 A.

OBJECT OF THE INVENTION

The object of the present invention is to provide a new and favourable manner of implementing overload protection in a hydraulic crane.

SUMMARY OF THE INVENTION

According to the present invention, said object is achieved by a hydraulic crane having the features defined herein.

The hydraulic crane according to the present invention comprises:

- a crane base;
- a column which is rotatably mounted to the crane base so as to be rotatable in relation to the crane base about an essentially vertical axis of rotation;
- a crane boom system comprising two or more liftable and lowerable crane booms which are articulately connected to each other, including at least a first crane boom which is articulately connected to the column and a second crane boom which is telescopically extensible to enable an adjustment of the extension length thereof;
- an electronic control device which is configured to prevent an execution of crane boom movements that would make the lifting moment of the crane exceed a lifting moment maximum value representing a maximum allowed value for the lifting moment of the crane; and
- sensors connected to the electronic control device and configured to establish values of variables which are related to the prevailing position of the crane booms of the crane boom system, wherein the electronic control device is configured to establish position information as to the prevailing position of the load suspension point of the crane boom system in relation to said vertical axis of rotation based on the values of these variables.

The electronic control device is configured, when it has established that the lifting moment of the crane has reached a limit value at a given level below the lifting moment maximum value, to prevent the execution of any combination of crane boom movements that would increase the horizontal distance between the load suspension point and said vertical axis of rotation and at the same time allow the execution of any combination of crane boom movements that keeps the horizontal distance between the load suspension point and said vertical axis of rotation unchanged or reduces the horizontal distance between the load suspension point and said vertical axis of rotation.

With the solution according to the present invention it will for instance be possible for the operator of the crane to move the load carried by the crane boom system directly vertically downwards from the position assumed by the load in a detected overload situation, and the crane operator may thereby put down the load at a spot on the ground or any other support surface directly vertically below said position without first having to move the load closer to the column of the crane, in contrast to a prior art overload protection system of the above-mentioned type where the crane operator has to move the load closer to the column of the crane after a stop caused by a detected overload situation.

An embodiment of the invention is characterized in:

- that the electronic control device in a first operating mode is configured, when it has established that the lifting moment of the crane has reached the limit value, to prevent the execution of any combination of crane boom movements that would increase the horizontal distance between the load suspension point and said vertical axis of rotation and at the same time allow the execution of any combination of crane boom movements that keeps the horizontal distance between the load suspension point and said vertical axis of rotation unchanged or reduces the horizontal distance between the load suspension point and said vertical axis of rotation;
- that the electronic control device in a second operating mode is configured to stop presently executed crane boom movements when it has been established by the electronic control device that the lifting moment of the crane has reached the lifting moment maximum value, and only allow such a stop to be followed by an execution of a combination of crane boom movements that reduces the horizontal distance between the load suspension point and said vertical axis of rotation; and
- that the crane comprises switching means, by means of which a crane operator may switch from the first operating mode to the second operating mode.

Thus, by switching from the first operating mode to the second operating mode, it will be possible for the operator of the crane to utilize the full lifting capacity of the crane and thereby move the load a small horizontal distance further away from the column of the crane.

Further advantages as well as advantageous features of the hydraulic crane according to the invention will appear from the following description and the dependent claims.

BRIEF DESCRIPTION OF THE DRAWINGS

The invention will in the following be more closely described by means of embodiment examples, with reference to the appended drawings. In the drawings.

DETAILED DESCRIPTION OF EMBODIMENTS OF THE INVENTION

In this description, the expression "liftable and lowerable crane boom" refers to a crane boom which can be pivoted in a vertical plane so as to thereby perform liftings and lowerings of a load carried by the crane. The expression "hydraulic cylinder for lifting and lowering the crane boom" here refers to the hydraulic cylinder which is associated with the liftable and lowerable crane boom and which carries out the pivoting thereof in a vertical plane.

Figure 1:
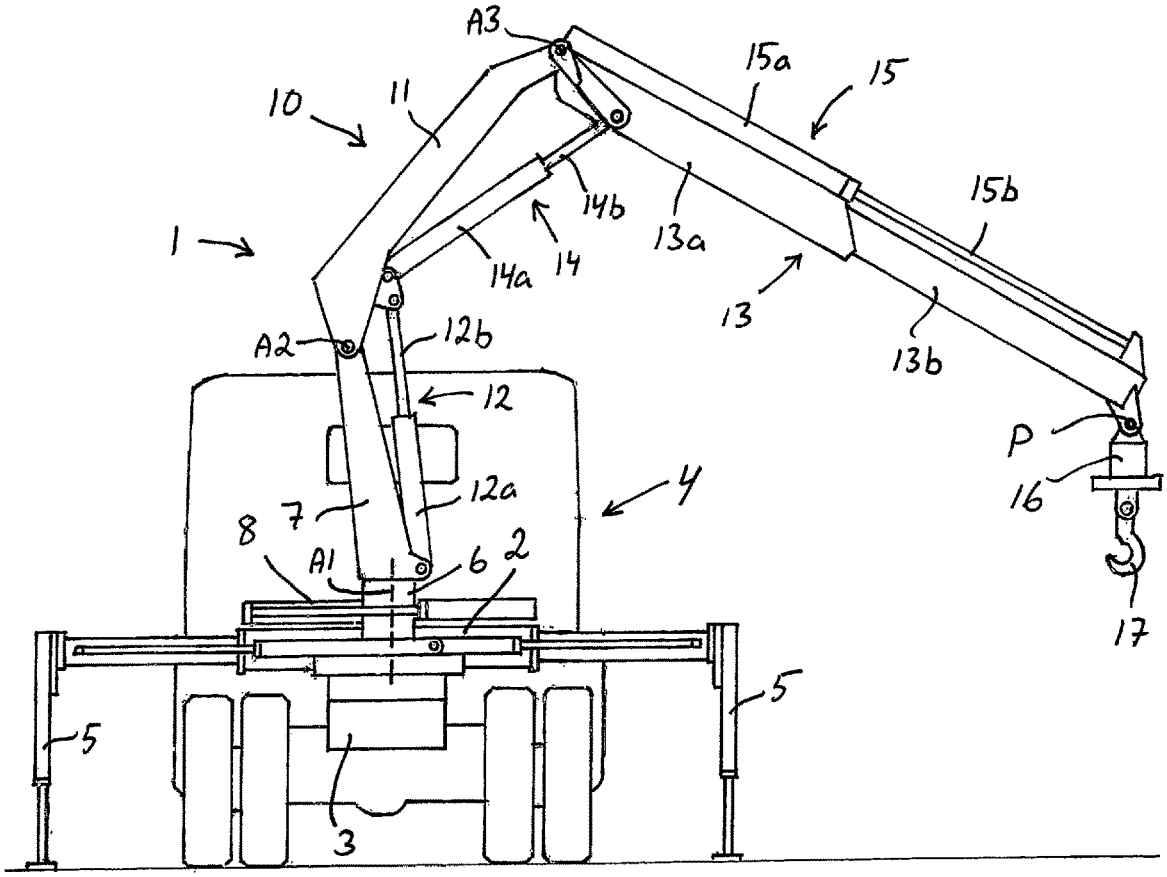
FIG. 1 is a schematic rear view of a lorry provided with a hydraulic crane according to an embodiment of the present invention.

FIG. 1 shows a hydraulic crane 1 mounted on a frame 2, which for instance can be connected to the chassis 3 of a lorry 4. The frame 2 is provided with adjustable support legs 5 for supporting the crane 1.

The crane 1 comprises:

a crane base 6, which is fixed to the frame 2;

a column 7, which is rotatably mounted to the crane base 6 so as to be rotatable in relation to the crane base about an essentially vertical axis of rotation A1 by means of an actuating device 8;

a liftable and lowerable first crane boom 11, here denominated inner boom, which is articulately connected to the column 7 in such a manner that it is pivotable in relation to the column about an essentially horizontal axis of rotation A2;

a first hydraulic cylinder 12, here denominated lifting cylinder, for lifting and lowering the inner boom 11 in relation to the column 7;

a liftable and lowerable second crane boom 13, here denominated outer boom, which is articulately connected to the inner boom 11 in such a manner that it is pivotable in relation to the inner boom about an essentially horizontal axis of rotation A3; and a second hydraulic cylinder 14, here denominated outer boom cylinder, for lifting and lowering of the outer boom 13 in relation to the inner boom 11.

In the illustrated example, the lifting cylinder 12 comprises a cylinder part 12*a* which is articulately connected to the column 7, and a piston which is received in the cylinder part 12*a* and displaceable in relation to it, wherein the piston is fixed to a piston rod 12*b* which is articulately connected to the inner boom 11. The outer boom cylinder 14 comprises a cylinder part 14*a* which is articulately connected to the inner boom 11, and a piston which is received in the cylinder part 14*a* and displaceable in relation to it, wherein the piston is fixed a piston rod 14*b* which is articulately connected to the outer boom 13.

In the illustrated embodiment, the crane boom system 10 of the crane 1 is formed by the inner boom 11 and the outer boom 13 and the associated hydraulic cylinders. However, the crane boom system 10 of the crane 1 may also include more than two liftable and lowerable crane booms articulately connected to each other. As an example, a liftable and lowerable crane boom in the form of a so-called jib may be mounted to the outer end of the outer boom 13 to thereby make it possible to perform lifting operations requiring a greater range.

The outer boom 13 is telescopically extensible to enable an adjustment of the extension length L thereof. In the illustrated example, the outer boom 13 comprises one telescopic crane boom section 13*b*, which is slidably received in a base section 13*a* of the outer boom 13 and displaceable in the longitudinal direction of the base section 13*a* for adjustment of the extension length L of the outer boom 13. The telescopic crane boom section 13*b* is displaceable in relation to the base section 13*a* by means of a hydraulic cylinder 15 carried by the outer boom 13. In the illustrated example, this hydraulic cylinder 15 comprises a cylinder part 15*a* which is fixed to the base section 13*a*, and a piston which is received in the cylinder part 15*a* and displaceable in relation to it, wherein the piston is fixed to a piston rod 15*b* which is fixed to the telescopic crane boom section 13*b*. As an alternative, the outer boom 13 could comprise two or more telescopic crane boom sections 13*b* which are mutually slidable in relation to each other in the longitudinal direction of the outer boom 13 for adjustment of the extension length thereof.

In the illustrated embodiment, a rotator 16 is articulately fastened to a load suspension point P at the outer end of the outer boom 13, which rotator in its turn carries a lifting hook 17. In this case, the load to be carried by the crane 1 is fixed to the lifting hook 17, for instance by means of lifting wires or the similar. As an alternative, any other suitable type of lifting tool may be connected to the load suspension point P at the outer end of the crane boom system.

The control system for controlling the hydraulic cylinders 12, 14, 15 of the crane boom system 10 comprises a pump 20 (see FIG. 5) which pumps hydraulic fluid from a reservoir 21 to a directional-control-valve block 22. The directional-control-valve block 22 comprises a directional-control-valve section 23 for each of the hydraulic cylinders 12, 14 and 15 of the crane boom system 10, to which hydraulic cylinders hydraulic fluid is supplied in a conventional manner in dependence on the setting position of the slide member in the respective directional-control-valve section 23.

Figure 2:
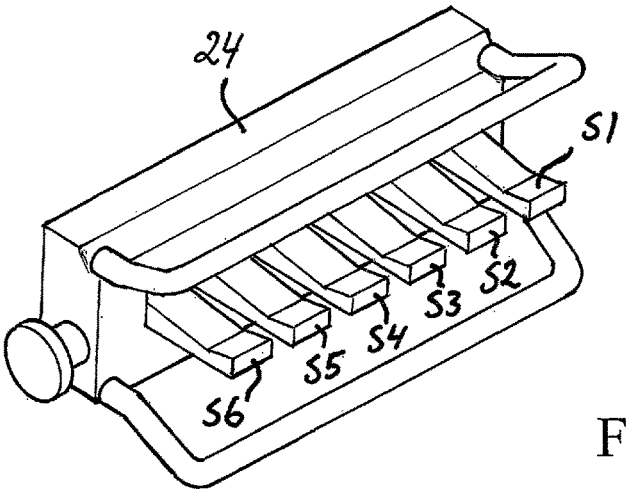
FIG. 2 is a schematic perspective view of a manoeuvring unit with a number of manoeuvring members for controlling different crane functions.

The crane 1 comprises a manoeuvring unit 24 (see FIG. 2) with one or more maneuvering members S1-S6 configured to be manoeuvrable by a crane operator in order to control the position of the load suspension point P of the crane boom system 10. Control signals are transmitted via cable or a wireless connection from the manoeuvring unit 24 to an electronic control device 25, for instance in the form of a microprocessor, which in its turn controls the setting position of the slide members in the valve sections 23 of the directional-control-valve block 22 in dependence on control signals from the manoeuvring unit 24 related to the manoeuvring of the maneuvering members S1-S6.

According to a first alternative, the electronic control device 25 is configured to control the crane boom movements on the basis of the control signals from the manoeuvring unit 24 and a calculation model for boom tip control. The calculation model may for instance be stored as an algorithm in a memory of the electronic control device 25. In the case of boom tip control, a first maneuvering member S1 may be used for controlling the rotation of the column 7 in relation to the crane base 6 about the vertical axis of rotation A1, a second maneuvering member S2 may be used for controlling the movement of the load suspension point P in the vertical direction and a third maneuvering member S3 may be used for controlling the movement of the load suspension point P in the horizontal direction. In the case of boom tip control, the manoeuvring unit 24 could as an alternative be provided with a joystick to be used for controlling the movement of the load suspension point P in the vertical and horizontal directions.

As an alternative to boom tip control, a first maneuvering member S1 may be used for controlling the rotation of the column 7 in relation to the crane base 6 about the vertical axis of rotation A1, a second maneuvering member S2 may be used for controlling the lifting cylinder 12, a third maneuvering member S3 may be used for controlling the outer boom cylinder 14 and a fourth maneuvering member S4 may be used for controlling the hydraulic cylinder 15.

Figure 5:
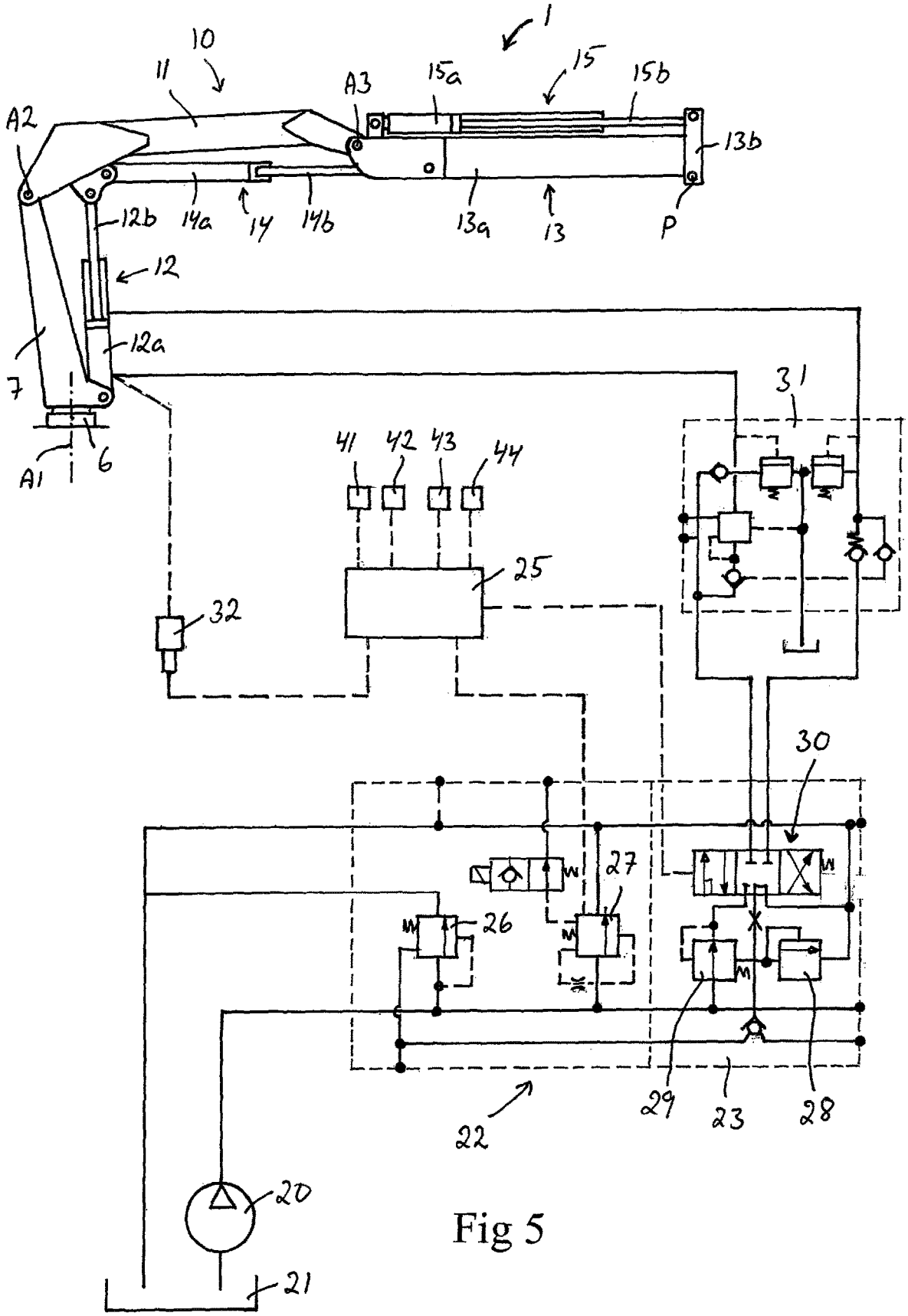
FIG. 5 is a schematic illustration of a crane according to an embodiment of the invention.

Each individual directional-control-valve section 23 controls the magnitude and the direction of the flow of hydraulic fluid to a specific hydraulic cylinder 12, 14, 15 and thereby controls a specific crane function. For the sake of clarity, only the directional-control-valve section 23 for the lifting cylinder 12 is illustrated in FIG. 5.

The directional-control-valve block 22 further comprises a shunt valve 26, which pumps excessive hydraulic fluid back to the reservoir 21, and an electrically controlled dump valve 27, which can be made to return the entire hydraulic flow from the pump 20 directly back to the reservoir 21.

In the illustrated example, the directional-control-valve block 22 is of load-sensing and pressure-compensating type, which implies that the magnitude of the hydraulic flow supplied to a hydraulic cylinder is always proportional to the position of the slide member in the corresponding directional-control-valve section 23. The directional-control-valve section 23 comprises a pressure limiter 28, a pressure compensator 29 and a directional-control-valve 30. Directional-control-valve blocks and directional-control-valve sections of this type are known and available on the market. Also other types of valve devices then the one here described may of course be used in a crane according to the present invention.

A load holding valve 31 is arranged between the respective hydraulic cylinder 12, 14, 15 and the associated directional-control-valve section 23, which load holding valve makes sure that the load will remain hanging when the hydraulic system runs out of pressure when the dump valve 27 is made to return the entire hydraulic flow from the pump 20 directly back to the reservoir 21.

Sensors 41, 42, 43, 44 (schematically illustrated in FIG. 5) are connected to the electronic control device 25 and configured to establish values of variables α, β, L, θ (see FIG. 3) which are related to the prevailing position of the crane booms 11, 13 of the crane boom system 10, and the electronic control device 25 is configured to continuously establish position information as to the prevailing position of the load suspension point P of the crane boom system 10 in relation to the vertical axis of rotation A1 based on the values of these variables α, β, L, θ. In a crane 1 with the configuration illustrated in FIGS. 1, 3, 4 and 5, said variables comprise:

- a variable α representing the swing-out angle of the inner boom 11;
- a variable β representing the swing-out angle of the outer boom 13;
- a variable L representing the extension length of the outer boom 13; and
- a variable θ representing the slewing angle of the column 7.

The swing-out angles α, β, the extension length L and the slewing angle θ together define the position of the crane boom system 10 and the load suspension point P of the crane according to FIGS. 1, 3, 4 and 5, and these variables will consequently provide complete information about the prevailing position of the crane boom system 10 and the crane booms 11, 13 included therein.

Figure 3:
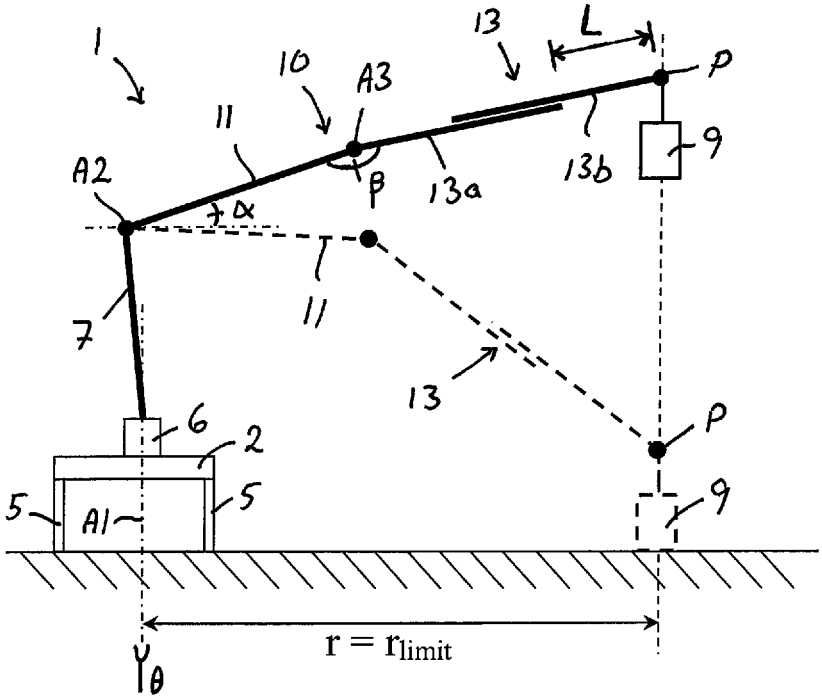
FIG. 3 is an outline diagram of the crane of FIG. 1.
Figure 4:
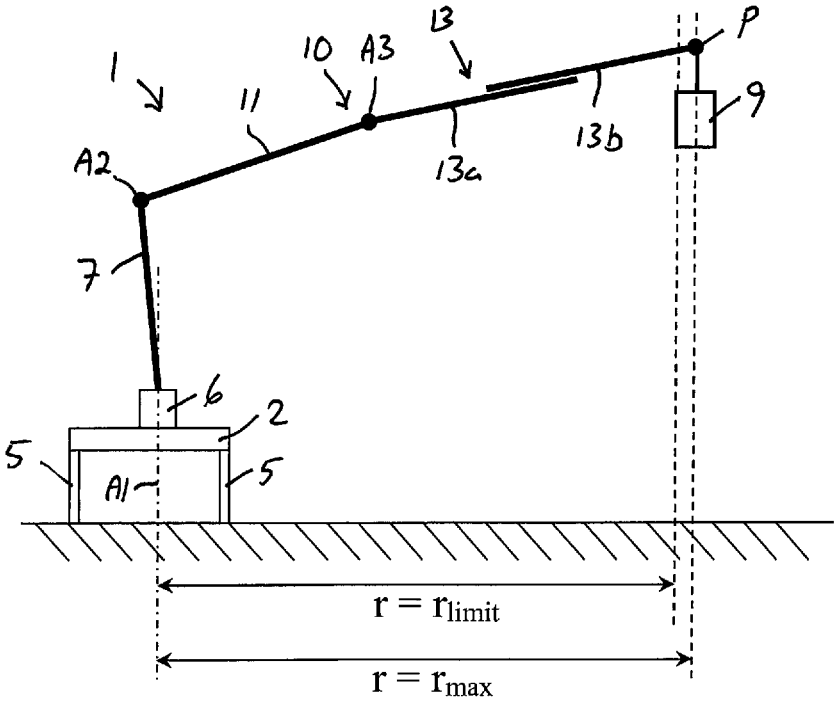
FIG. 4 is another outline diagram of the crane of FIG. 1.

In the example illustrated in FIGS. 3 and 4, the swing-out angle α of the inner boom 11 is defined as the angle between the longitudinal axis of the inner boom 11 and the horizontal plane, whereas the swing-out angle β of the outer boom 13 is defined as the angle between the longitudinal axis of the outer boom 13 and the longitudinal axis of the inner boom 11.

The swing-out angle α of the inner boom 11 may for instance be established by means of a sensor 41 which continuously senses the position of the piston rod 12*b* in relation to the cylinder part 12*a* of the lifting cylinder 12, whereas the swing-out angle β of the outer boom 13 may be established by means of a sensor 42 which continuously senses the position of the piston rod 14*b* in relation to the cylinder part 14*a* of the outer boom cylinder 14. The swing-out angle α is a function of the extension position of the piston rod 12*b* of the lifting cylinder 12, and the swing-out angle β is a function of the extension position of the piston rod 14*b* of the outer boom cylinder 14. Alternatively, these swing-out angles α, β could be established by means of suitable angle sensors, which directly sense the respective swing-out angle.

The extension length L of the outer boom 13 may for instance be established by means of a sensor 43 which continuously senses the position of the piston rod 15*b* in relation to the cylinder part 15*a* of the hydraulic cylinder 15. Alternatively, the extension length L could be established by means of a measuring device comprising an ultrasonic transmitter and an ultrasonic receiver of the type described in U.S. Pat. No. 5,877,693 A or by means of any other suitable measuring device.

The slewing angle θ of the column 7 in relation to the crane base 6 is established by means of a sensor 44 which continuously senses the slewing position of the column.

The electronic control device 25 is connected to the above-mentioned sensors 41, 42, 43, 44 in order to receive measuring signals from these sensors related to the swing-out angle α, the swing-out angle β, the extension length L and the slewing angle θ.

The electronic control device 25 is configured to prevent an execution of crane boom movements that would make the lifting moment of the crane 1 exceed a lifting moment maximum value $M_{max}$ representing a maximum allowed value for the lifting moment of the crane 1. When it has been established by the electronic control device 25 that the lifting moment of the crane 1 has reached a limit value $M_{limit}$ at a given level below the lifting moment maximum value $M_{max}$, the electronic control device 25 is configured to prevent the execution of any combination of crane boom movements that would increase the lifting radius r (see FIG. 3), i.e. the horizontal distance between the load suspension point P and the above-mentioned vertical axis of rotation A1, and allow the execution of any combination of crane boom movements that keeps lifting radius r unchanged or reduces the lifting radius r. Thus, when it has been established that the lifting moment of the crane 1 has reached the limit value $M_{limit}$, the electronic control device 25 prevents the load suspension point P from being moved in a direction which would increase the lifting radius r and at the same time allows any other movement of the load suspension point P.

The position of the inner boom 11 and the outer boom 13 in a situation when the lifting moment of the crane 1 has reached the limit value $M_{limit}$ is illustrated by continuous lines in FIG. 3. The lifting radius r reached in this situation is indicated as $r_{limit}$ in FIGS. 3 and 4. With the solution according to the present invention, the crane operator may move the load 9 directly downwards from the position illustrated with continuous lines in FIG. 3 to the position illustrated with broken lines in FIG. 3. The crane operator may consequently put down the load 9 on a spot directly below the point reached by the load suspension point P in the situation when the lifting moment of the crane 1 reached the limit value $M_{limit}$.

The limit value $M_{limit}$ preferably corresponds to a predetermined percentage of the lifting moment maximum value $M_{max}$. The limit value $M_{limit}$ may for instance lie within an interval corresponding to 95-99%, preferably 98-99%, of the lifting moment maximum value $M_{max}$.

Two different operating modes, in the following denominated first and second operating modes, are with advantage provided for the electronic control device 25. In the first operating mode the electronic control device 25 is configured, when it has established that the lifting moment of the crane has reached the limit value $M_{limit}$, to prevent the execution of any combination of crane boom movements that would increase the lifting radius r and allow the execution of any combination of crane boom movements that keeps the lifting radius r unchanged or reduces the lifting radius r and allow the execution of any combination of crane boom movements that keeps the lifting radius r unchanged or reduces the lifting radius r. In the second operating mode the electronic control device 25 is configured to stop presently executed crane boom movements when it has been established by the electronic control device 25 that the lifting moment of the crane has reached the lifting moment maximum value $M_{max}$, and only allow such a stop to be followed by an execution of a combination of crane boom movements that reduces the lifting radius r. In this case, the crane 1 comprises switching means, for instance in the form of a maneuvering member S6 on the manoeuvring unit 24, by means of which the crane operator may switch from the first operating mode to the second operating mode. The lifting radius r that may be reached in the first operating mode is indicated as $r_{limit}$ in FIG. 4, whereas the lifting radius r that may be reached in the second operating mode is indicated as $r_{max}$ in FIG. 4.

The electronic control device 25 is with advantage, in a conventional manner, adapted to convert the prevailing limit value $M_{limit}$ and lifting moment maximum value $M_{max}$, respectively, into a corresponding value for the maximum allowed working pressure for the lifting cylinder 12. In the embodiment illustrated in FIG. 5, the crane 1 comprises a pressure sensor 32 which is arranged to measure the hydraulic pressure on the piston side of the lifting cylinder 12. The electronic control device 25 is connected to the pressure sensor 32 in order to receive measuring signals from this sensor related to said hydraulic pressure. The electronic control device 25 continuously reads the output signals from the pressure sensor 32 and compares the output signal from the pressure sensor with the established value of the maximum allowed working pressure for the lifting cylinder 12. If the pressure sensed by the pressure sensor 32 exceeds the established maximum allowed working pressure for the lifting cylinder 12, the electronic control device 25 delivers a signal to the dump valve 27, which dumps the hydraulic flow directly to the reservoir 21, which results in that the hydraulic system runs out of pressure and that the presently executed crane boom movements are stopped. In this situation, the load 9 is held by means of the load holding valve 31.

In the example described above, the electronic control device 25 is configured to let the maximum allowed working pressure for the lifting cylinder 12 represent the maximum allowed hydraulic pressure on the piston side of the lifting cylinder. However, the electronic control device 25 could alternatively be configured to let the maximum allowed working pressure for the lifting cylinder 12 represent the maximum allowed differential pressure in the lifting cylinder. This differential pressure is defined as the hydraulic pressure on the piston side of the lifting cylinder minus the hydraulic pressure on its piston rod side divided by the cylinder ratio. In the last-mentioned case, the electronic control device 25 is also arranged to receive measuring signals from a pressure sensor which measures the hydraulic pressure on the piston rod side of the lifting cylinder 12 so as to thereby be able to establish the prevailing differential pressure of the lifting cylinder and compare this differential pressure with the established value of the maximum allowed working pressure for the lifting cylinder. The expression "working pressure" as used in this description consequently refers either to the hydraulic pressure on the piston side of a hydraulic cylinder or the differential pressure in a hydraulic cylinder.

The electronic control device 25 may be implemented by one single electronic control unit, as illustrated in FIG. 5. However, the electronic control device 25 could as an alternative be implemented by two or more mutually cooperating electronic control units.

The invention is of course not in any way limited to the embodiments described above. On the contrary, several possibilities to modifications thereof should be apparent to a person skilled in the art without thereby deviating from the basic idea of the invention as defined in the appended claims. The control system of the crane may for instance have another design than the control system which is illustrated in FIG. 5 and described above. Furthermore, the crane boom system of the crane could have another design than the crane boom system which is illustrated in FIGS. 1, 3, 4 and 5 and described above.

The invention claimed is:

1. A hydraulic crane comprising:

a crane base (6);

a column (7) rotatably mounted to the crane base (6) to be rotatable in relation to the crane base about an essentially vertical axis of rotation (A1);

a crane boom system (10) comprising two or more liftable and lowerable crane booms (11,13) articulately connected to each other, including at least a first crane boom (11) which is articulately connected to the column (7) and a second crane boom (13) telescopically extensible to enable an adjustment of the extension length thereof;

an electronic control device (25) configured to prevent an execution of crane boom movements that would make a lifting moment of the crane exceed a lifting moment maximum value (Mmax) representing a maximum allowed value for the lifting moment of the crane; and sensors (41, 42, 43, 44) connected to the electronic control device (25) and configured to establish values of variables (α, β, L, θ) related to a prevailing position of the crane booms (11, 13) of the crane boom system (10), wherein the electronic control device (25) is configured to establish position information to a prevailing position of a load suspension point (P) of the crane boom system (10) in relation to said vertical axis of rotation (A1) based on the values of these variables (α, β, L, θ), wherein the electronic control device (25), when the lifting moment of the crane (1) has reached a limit value (Mlimit) at a given level below the lifting moment maximum value (Mmax), is configured to prevent the execution of any combination of crane boom movements that would increase the horizontal distance (r) between the load suspension point (P) and said vertical axis of rotation (A1) and, at the same time, allow the execution of any combination of crane boom movements that keeps the horizontal distance (r) between the load suspension point (P) and said vertical axis of rotation (A1) unchanged.

2. A hydraulic crane according to claim 1, wherein the limit value (Mlimit) corresponds to a predetermined percentage of the lifting moment maximum value (Mmax).

3. A hydraulic crane according to claim 2, wherein the limit value (Mmax) lies within an interval corresponding to 95-99% of the lifting moment maximum value (Mmax).

4. A hydraulic crane according to claim 3, wherein the limit value (Mmax) lies within an interval corresponding to 98-99% of the lifting moment maximum value (Mmax).

5. A hydraulic crane according to claim 1, wherein the electronic control device (25) in a first operating mode is configured, when the lifting moment of the crane (1) has reached the limit value (Mlimit), to prevent the execution of any combination of crane boom movements that would increase the horizontal distance (r) between the load suspension point (P) and said vertical axis of rotation (A1) and at the same time allow the execution of any combination of crane boom movements that keeps the horizontal distance (r) between the load suspension point (P) and said vertical axis of rotation (A1) unchanged or reduces the horizontal distance (r) between the load suspension point (P) and said vertical axis of rotation (A1);

the electronic control device (25) in a second operating mode is configured to stop presently executed crane boom movements when the lifting moment of the crane has reached the lifting moment maximum value (Mmax), and only allow such a stop to be followed by an execution of a combination of crane boom movements that reduces the horizontal distance (r) between the load suspension point (P) and said vertical axis of rotation (A1); and the crane (1) comprises switching means (S6), by which a crane operator may switch from the first operating mode to the second operating mode.

6. A hydraulic crane according to claim 1, wherein said variables comprise at least a first variable (α) representing the swing-out angle of the first crane boom (11), a second variable (β) representing the swing-out angle of the second crane boom (13) and a third variable (L) representing the extension length of the second crane boom (13).

7. A hydraulic crane according to claim 6, wherein the first variable (α) is defined as an angle between a longitudinal axis of the first crane boom (11) and a horizontal plane, the second variable (β) is defined as an angle between a longitudinal axis of the second crane boom (13) and the longitudinal axis of the first crane boom (11), the third variable (L) is defined as distance between an outer end of a base section (13*a*) and the load suspension point (P) on a telescopic section (13*b*) of the second crane boom (13).

8. A hydraulic crane according to claim 7, additionally comprising a fourth variable (8) which is a slewing angle of the column (7).

9. A hydraulic crane according to claim 1, wherein the crane (1) comprises a manoeuvring unit (24) with one or more maneuvering members (S1, S2, S3) configured to be manoeuvrable by a crane operator to control the position of the load suspension point (P) of the crane boom system (10), the manoeuvring unit (24) is configured to supply the electronic control device (25) with control signals related to the manoeuvring of said one or more maneuvering members (S1, S2, S3), and the electronic control device (25) is configured to control the crane boom movements on the basis of said control signals and a calculation model for boom tip control.

10. A hydraulic crane according to claim 1, wherein said first crane boom (11) is pivoted about a horizontal axis (A2) by a hydraulic cylinder (12) and additionally comprising coupled to said hydraulic cylinder (12), a directional-control-valve block (22), a reservoir (21) containing hydraulic fluid, a pump (20) arranged to pump the hydraulic fluid to the direction-control-valve block (22), said valve block (22) comprising a shunt valve (26) arranged to pump excess hydraulic fluid to the reservoir (21), an electrically-controlled dump valve (27) arranged to return entire hydraulic flow back to the reservoir (21), and a directional-control-valve-section (23) including a pressure limiter (28), a pressure compensator (29), and a directional control valve (30) directly coupled to the electronic control device (25).

11. A hydraulic crane according to claim 10, additionally comprising a load holding valve (31) coupled to said directional control valve (30) and cylinder (12) and arranged to ensure load remains hanging when the hydraulic system runs out of pressure and the dump valve (27) returns the entire hydraulic flow back to the reservoir (21).

* * * * *